US009776074B1

(12) United States Patent
King

(10) Patent No.: US 9,776,074 B1
(45) Date of Patent: Oct. 3, 2017

(54) PRACTICE BOW AND ARROW SET

(71) Applicant: Janette King, Stewartsville, MO (US)

(72) Inventor: Janette King, Stewartsville, MO (US)

( * ) Notice: Subject to any disclaimer, the term of this patent is extended or adjusted under 35 U.S.C. 154(b) by 0 days.

(21) Appl. No.: 15/138,396

(22) Filed: Apr. 26, 2016

(51) Int. Cl.

| | |
|---|---|
| ***F41B 5/14*** | (2006.01) |
| ***F41J 1/10*** | (2006.01) |
| ***F41J 3/00*** | (2006.01) |
| ***A63F 9/02*** | (2006.01) |
| ***F41B 5/10*** | (2006.01) |
| ***F41B 5/00*** | (2006.01) |
| ***F42B 8/12*** | (2006.01) |

(52) U.S. Cl.
CPC ..... *A63F 9/0208* (2013.01); *A63F 9/0252* (2013.01); *F41B 5/0005* (2013.01); *F41B 5/10* (2013.01); *F41B 5/14* (2013.01); *F41J 1/10* (2013.01); *F41J 3/00* (2013.01); *F41J 3/0004* (2013.01); *F41J 3/0038* (2013.01); *F42B 8/12* (2013.01); *A63F 2009/023* (2013.01)

(58) Field of Classification Search
CPC .... A41G 1/06; A47G 1/14; A47G 1/06; F41B 5/00; F41B 5/14; F42B 6/08; F41J 1/10; F41J 3/00; F41J 3/0038; F41J 3/003877
See application file for complete search history.

(56) References Cited

U.S. PATENT DOCUMENTS

| | | | | |
|---|---|---|---|---|
| 397,950 A | | 2/1889 | White | |
| 429,953 A | | 6/1890 | Pratt | |
| 667,630 A | | 2/1901 | Kratz-Boussac | |
| 2,231,640 A | | 2/1941 | Rubin | |
| D172,821 S | | 8/1954 | Cass | |
| 2,839,857 A | * | 6/1958 | Teller | A47G 1/06 40/721 |
| 3,455,553 A | | 7/1969 | Melvin | |
| 3,542,365 A | * | 11/1970 | Gantz | F41J 1/10 248/467 |
| 3,841,635 A | | 10/1974 | Wilson | |
| 3,855,991 A | | 12/1974 | Imatt | |
| 4,625,974 A | * | 12/1986 | Andrews | F41J 3/0019 273/404 |
| 5,921,875 A | * | 7/1999 | Bickel | F42B 6/04 403/299 |
| 6,553,704 B1 | * | 4/2003 | Pigg | A47G 1/14 40/721 |
| 2004/0032087 A1 | * | 2/2004 | Kim | F41J 3/0019 273/348.3 |
| 2006/0046877 A1 | * | 3/2006 | Gajda, Jr. | F42B 6/10 473/572 |

(Continued)

*Primary Examiner* — John Ricci

(57) ABSTRACT

The practice bow and arrow set is an apparatus designed for indoor or outdoor use. The practice bow and arrow set displays a training targets of game animals. The game animals displayed in the target have appropriate target areas of the game animal highlighted. The target is displayed behind a transparent shield. The bow of the practice bow and arrow set can be a full size bow suitable for hunting. The arrow of the practice bow and arrow set is the size and weight of an arrow suitable for hunting but the tip of the arrow has been replaced with a suction cup. When shot at the target, the arrow adheres to the transparent shield allowing the shooter to see exactly where the arrow struck the target. The practice bow and arrow set comprises a bow, a plurality of arrows, a plurality of targets, a target display box and at least one telescoping leg.

3 Claims, 7 Drawing Sheets

(56) References Cited

U.S. PATENT DOCUMENTS

| | | | | |
|---|---|---|---|---|
| 2008/0054570 | A1* | 3/2008 | Potterfield | F41J 5/24<br>273/403 |
| 2012/0079751 | A1* | 4/2012 | Singer | A47G 1/06<br>40/359 |

* cited by examiner

PRACTICE BOW AND ARROW SET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of weapons for projecting missiles without the use of propellants, more specifically, an archery training set.

SUMMARY OF INVENTION

The practice bow and arrow set is an apparatus designed for indoor or outdoor use. The practice bow and arrow set displays a training targets of game animals. The game animals displayed in the target have appropriate target areas of the game animal highlighted. The target is displayed behind a transparent shield to prevent damage to the target during training sessions. The bow of the practice bow and arrow set can be a full size bow suitable for hunting. The arrow of the practice bow and arrow set is the size and weight of an arrow suitable for hunting but the tip of the arrow has been replaced with a suction cup. When shot at the target, the arrow adheres to the transparent shield allowing the shooter to see exactly where the arrow struck the target.

These together with additional objects, features and advantages of the practice bow and arrow set will be readily apparent to those of ordinary skill in the art upon reading the following detailed description of the presently preferred, but nonetheless illustrative, embodiments when taken in conjunction with the accompanying drawings.

In this respect, before explaining the current embodiments of the practice bow and arrow set in detail, it is to be understood that the practice bow and arrow set is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the practice bow and arrow set.

It is therefore important that the claims be regarded as including such equivalent construction insofar as they do not depart from the spirit and scope of the practice bow and arrow set. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
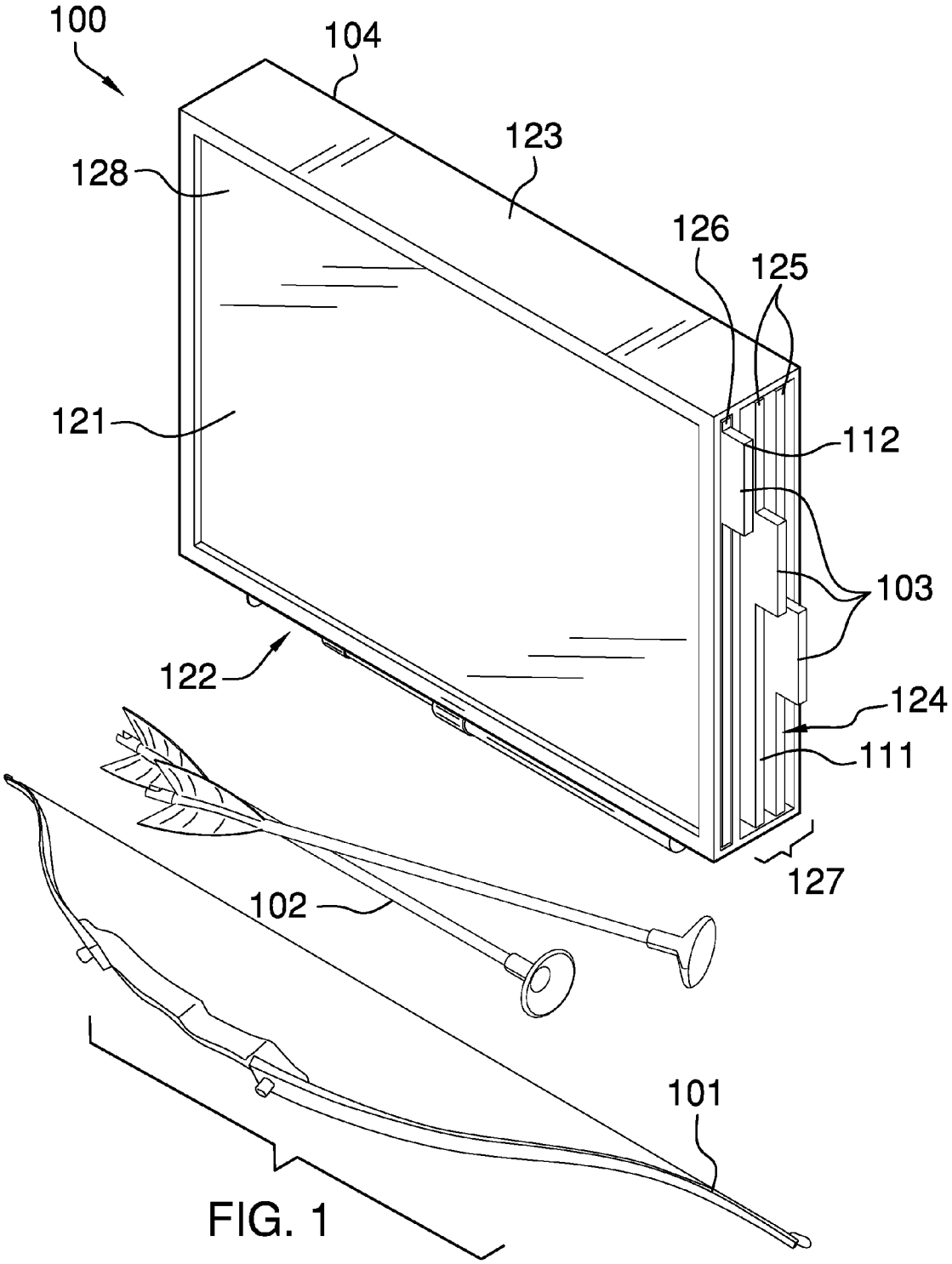
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

The practice bow and arrow set 100 (hereinafter invention) comprises a bow 101, a plurality of arrows 102, a plurality of targets 103, a target display box 104, and at least one telescoping leg 105. The invention 100 is an apparatus designed for indoor or outdoor use. The invention 100 displays training targets of game animals 114. The game animals 114 displayed in the target have appropriate target areas 115 of the game animal highlighted. The target is displayed behind a transparent shield 128 to protect the target from damage during training sessions. The bow 101 of the invention 100 can be a full size bow suitable for hunting. The arrow of the invention 100 is the size and weight of an arrow suitable for hunting but the tip of the arrow has been replaced with a suction cup 133. When shot at the target, the arrow adheres to the transparent shield 128 allowing the shooter to see exactly where the arrow struck the target. The use of the suction cup 133 reduces the potential of an arrow to do damage thereby allowing the invention 100 to be used indoors.

The bow 101 is a commercially available bow that can be a compound, recurve or long bow depending on the user's preference.

Figure 7:
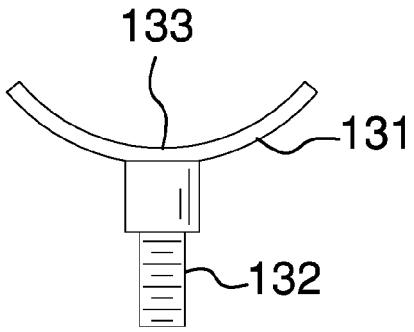
FIG. 7 is a detail view of an embodiment of the disclosure.
Figure 8:
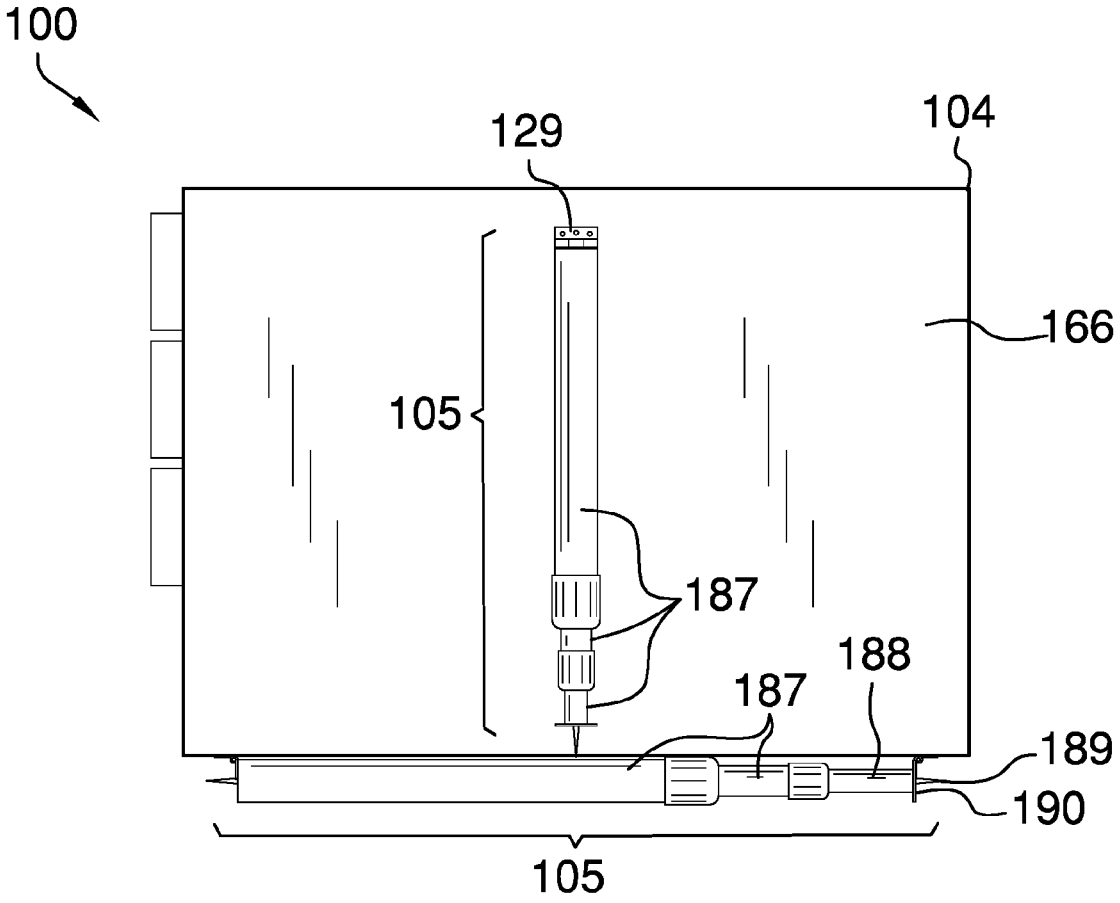
FIG. 8 is a rear view of an embodiment of the disclosure.
Figure 9:
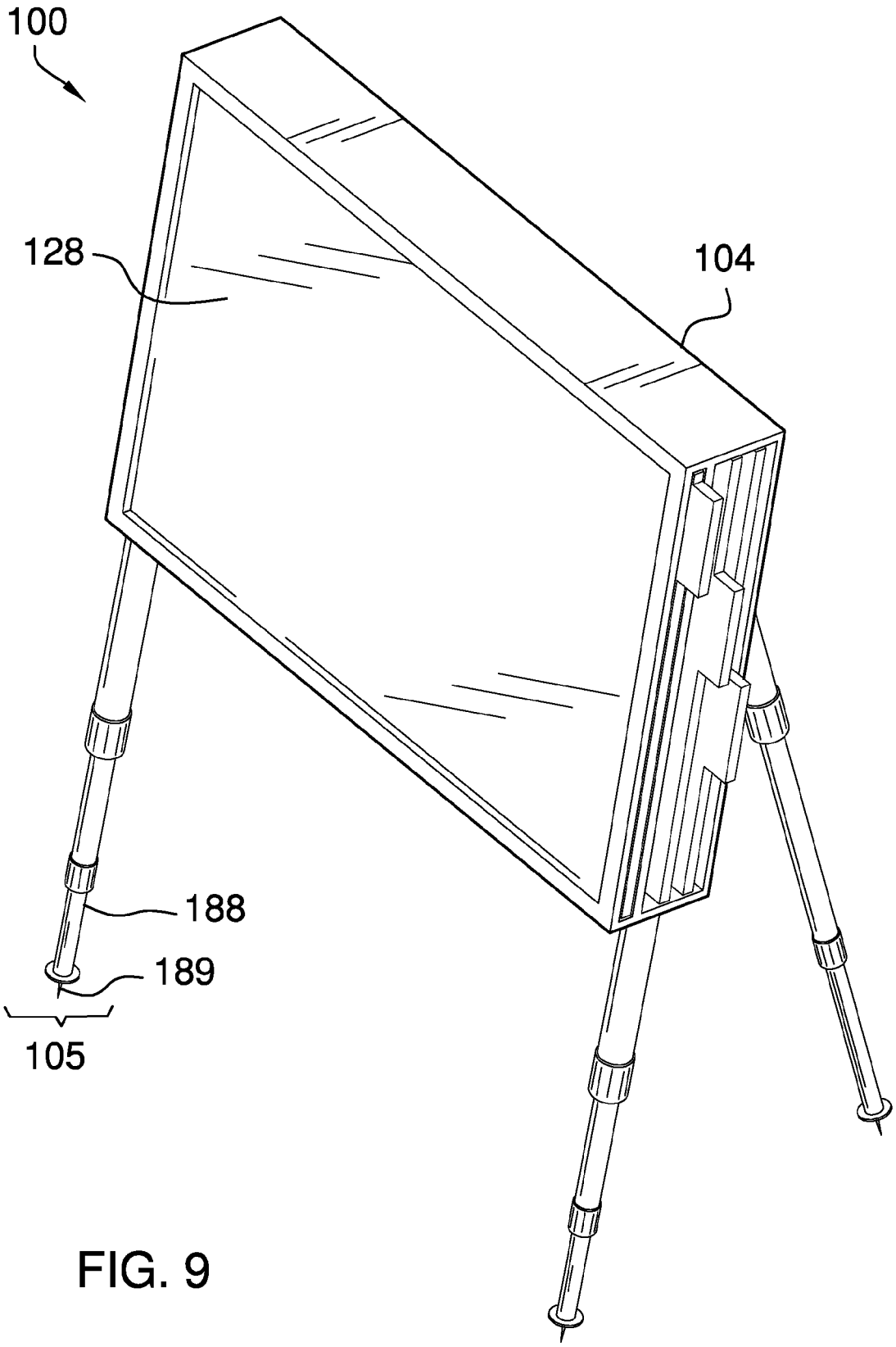
FIG. 9 is a perspective view of an embodiment of the disclosure fully erected.

The plurality of arrows 102 is commercially available practice arrows with replaceable screw in tips. The tips of the practice arrows are replaced with the replacement tip 131 that is shown in FIG. 7. As shown in FIG. 7, the replacement tip 131 further comprises a post 132 and a suction cup 133. The post 132 is formed with an exterior screw thread that is sized to fit the practice arrows that were selected as the plurality of arrows 102. The suction cup 133 is mounted on the post 132. Methods to mount the suction cup 133 on the post 132 include, but are not limited to: 1) the use of an adhesive; or, 2) the formation of a tube at the end of the suction cup 133 wherein the tube is slipped over the post 132 before the post 132 is screwed into the practice arrow.

The at least one telescoping leg 105 is a commercially available component, and is akin of tripods and devices used in photography. The at least one telescoping leg 105 is used to support the target display box 104 at an elevation 776 above a ground surface 777. The elevation 776 is adjustable, which implies the ability of the at least one telescoping leg 105 to adjust.

The plurality of targets 103 comprises a collection of individual targets 106. Each individual target 106 comprises an image 113 of a potential game animal 114. Within the image 113 of the game animal 114 are included indications of the appropriate target areas 115 for the specific game animal 114 in the image 113. The image 113 is stored in a rectangular frame 111. The rectangular frame 111 is a commercially available picture frame that is sized to hold the image 113. A tab 112 is attached to the frame 111 to allow for easy insertion and removal of the individual target 106 into the target display box 104. The tab 112 is a rectangular strip of material that is attached to the frame 111 using commercially available hardware.

The target display box 104 is used to hold and display the plurality of targets 103. The target display box 104 is a hollow rectangular box that is further defined with a front side 121, a bottom side 122, a top side 123 and a storage side 124. The target display box 104 further comprises a plurality of target slots 125, a transparent shield 128, a first plurality of ridges 141 and a second plurality of ridges 142. The at least one telescoping leg connector 129 attached to the bottom side 122 of the target display box 104. The top side 123 is the side of the target display box 104 that is distal from the bottom side 122.

Figure 2:
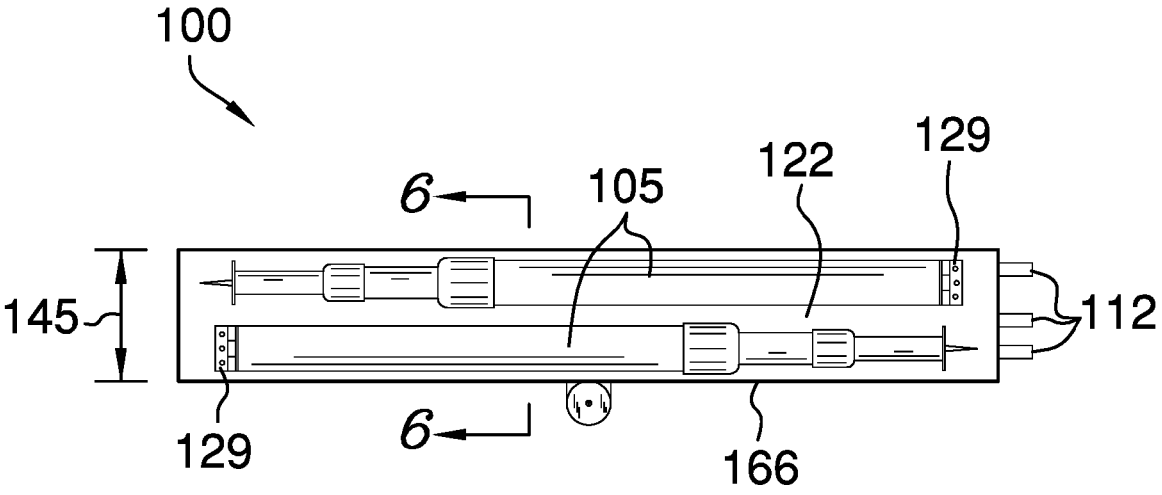
FIG. 2 is a bottom view of an embodiment of the disclosure.
Figure 3:
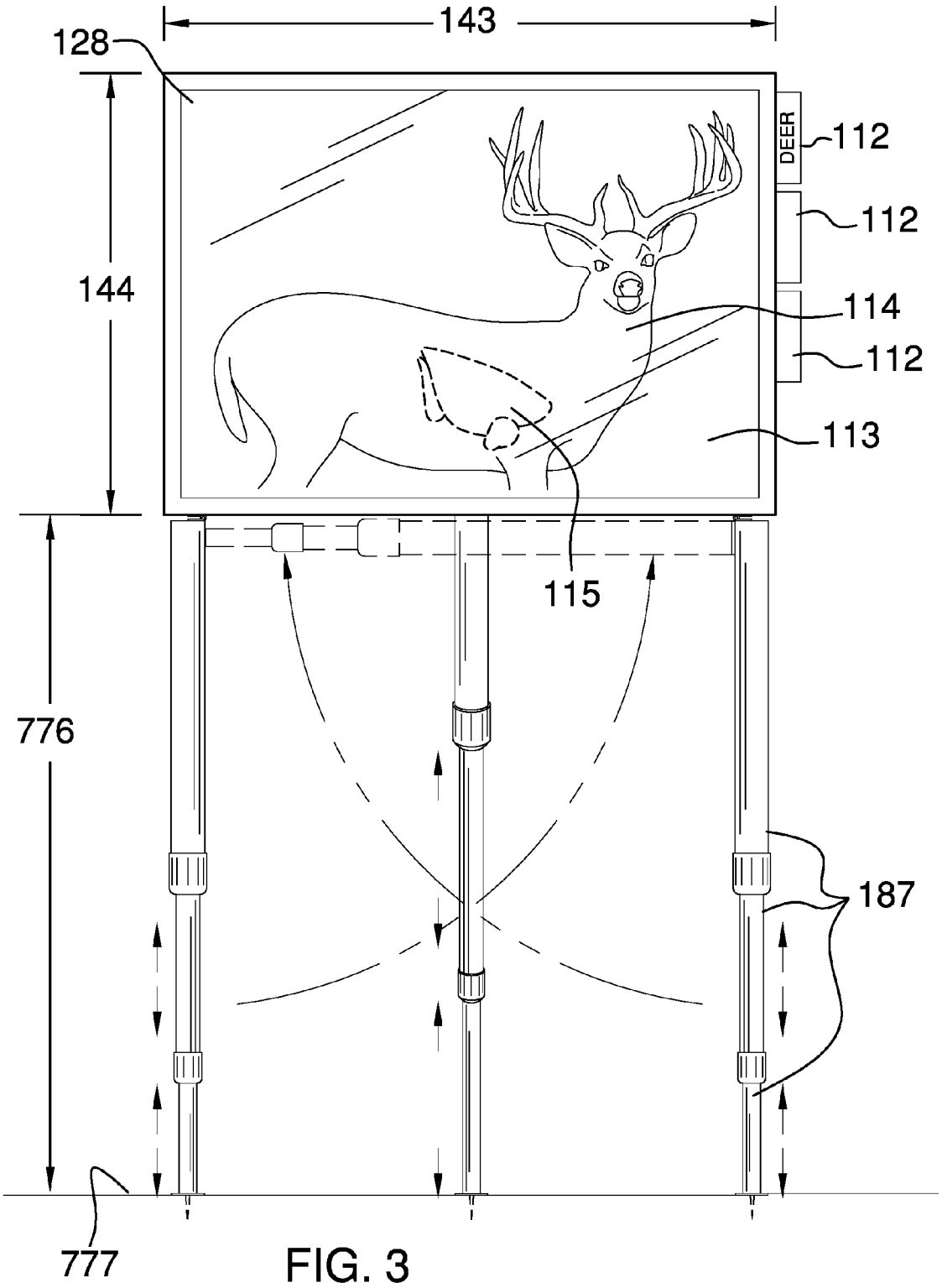
FIG. 3 is a front view of an embodiment of the disclosure.
Figure 4:
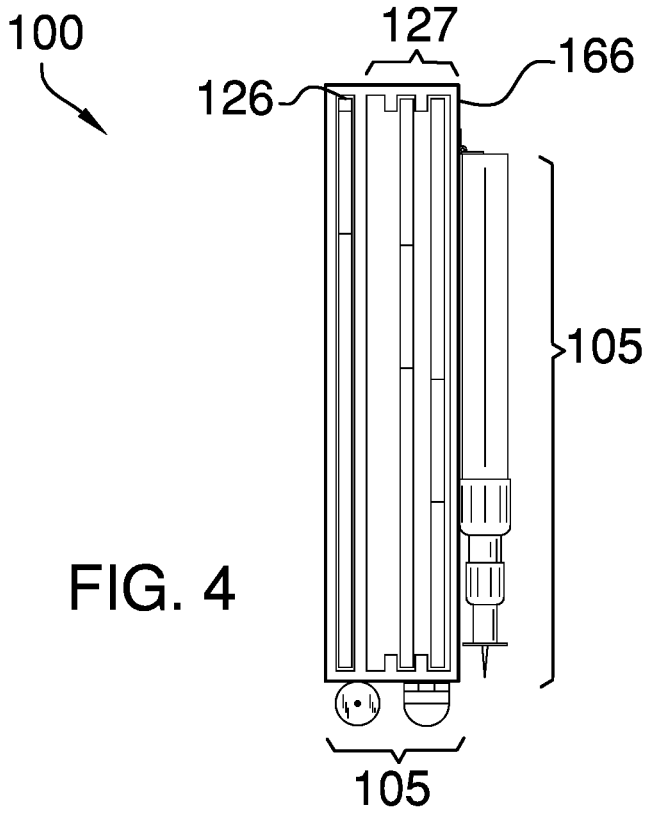
FIG. 4 is a side view of an embodiment of the disclosure.
Figure 5:
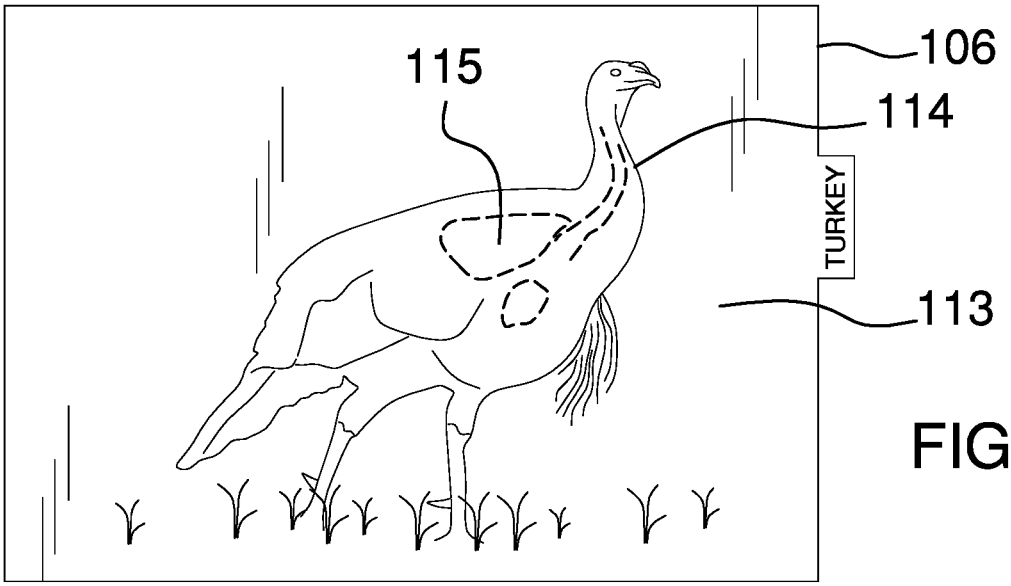
FIG. 5 is a detail view of an embodiment of the disclosure.
Figure 6:
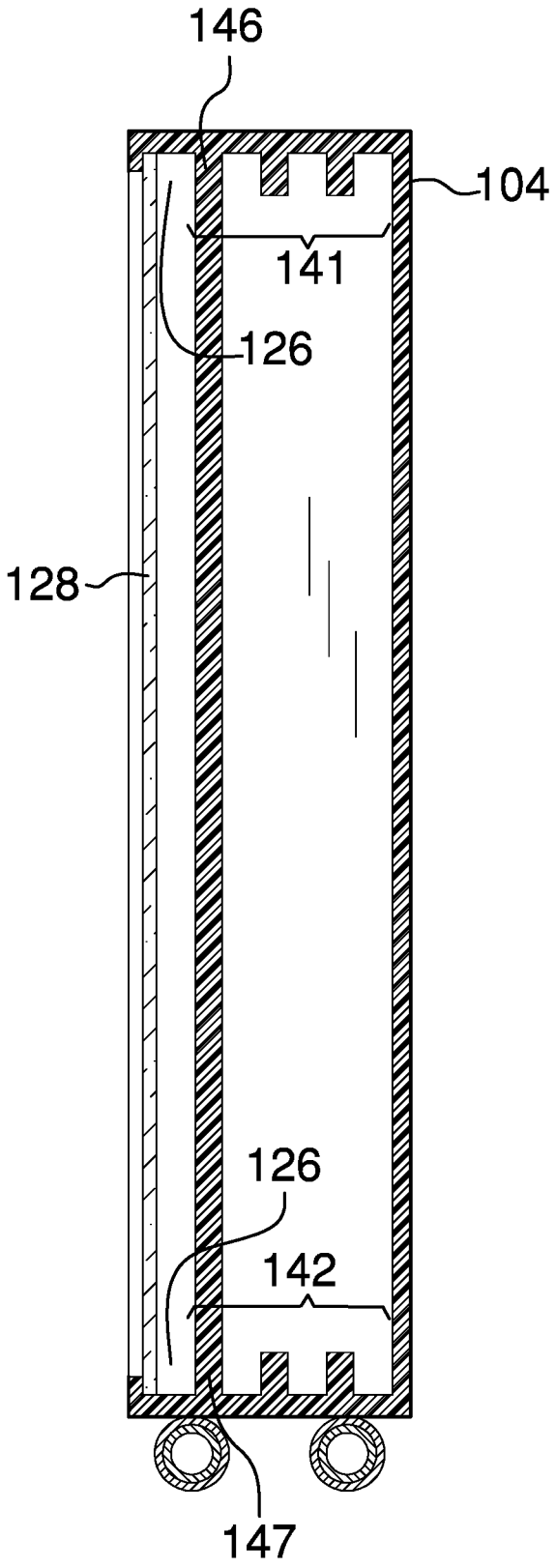
FIG. 6 is a detail view of an embodiment of the disclosure.

Referring to FIG. 2, two of the at least one telescoping leg 105 is hingedly attached to the bottom side 122 of the target display box 104. Referring to FIG. 4, one of the at least one telescoping leg 105 is hingedly attached to a rear surface 166 of the target display box 104. The rear surface 166 is distal of the transparent shield 128. A leg connector 129 is used to secure the at least one telescoping leg 105 to the target display box 104. The leg connector 129 is a glorified term for a hinge, which enables the respective one of the at least one telescoping leg 105 to pivot with respect to the target display box 104 in order to support the target display box 104 at the elevation 776.

The at least one telescoping leg 105 is further defined with a plurality of telescoping sections 187 that telescope with respect to one another in order to extend or retract. A spike member 189 is provided at a distal end 190 of a bottommost telescoping section 188. The bottommost telescoping member 188 is one of the plurality of telescoping sections 187. The spike member 189 is distal of the leg connector 129. Moreover, the spike member 189 is adapted to penetrate the ground surface 777 in order to stabilize the invention 100.

The at least one telescoping leg connector 129 is a piece of hardware with a hole formed with an interior screw thread that is sized to receive the exterior screw thread connector of a standard at least one telescoping leg 105.

The transparent shield 128 forms the front side 121 of the target display box 104. The transparent shield 128 is a clear rectangular piece of poly(methyl methacrylic) with a length 143 and width 144 that corresponds to the balance of the target display box 104. Of the two remaining unnamed sides of the target display box 104, one side is open to the interior of the target display box 104. This open side is referred to as the storage side 124 of the target display box 104.

The target display box 104 is further defined by a length 143, a width 144 and a depth 145. The inner dimension of the length 143 of the target display box 104 is greater than the outer dimension of the length 143 of each individual target 106. Similarly, the inner dimension of the width 144 of the target display box 104 is greater than the outer dimension of the width 144 of each individual target 106. This ensures that any individual target 106 will fit into the target display box 104. The interior of the target display box 104 further comprises a plurality of target slots 125. The plurality of target slots 125 is formed from a first plurality of ridges 141 and a second plurality of ridges 142.

The first plurality of ridges 141 run along the length 143 of the interior surface of top side 123 of the target display box 104. The inner dimension of the span of the depth 145 between the transparent shield 128 and the first top ridge 146 selected from the first plurality of ridges 142 is greater than the outer dimension of the depth 145 of each individual target 106. The inner dimension of the span of the depth 145 between any two adjacent ridges selected from the first plurality of ridges 141 is greater than the outer dimension of the depth 145 of each individual target 106. The second plurality of ridges 142 run along the length 143 of the interior surface of bottom side 122 of the target display box 104. The inner dimension of the span of the depth 145 between the transparent shield 128 and the first bottom ridge 147 selected from the second plurality of ridges 142 is greater than the outer dimension of the depth 145 of each individual target 106. The inner dimension of the span of the depth 145 between any two adjacent ridges selected from the second plurality of ridges 141 is greater than the outer dimension of the depth 145 of each individual target 106.

The plurality of target slots 125 further comprises a viewing slot 126 and a plurality of storage slots 127. The viewing slot 126 is defined as the space bounded by the following markers: the transparent shield 128, the first top ridge 146, the first bottom ridge 147 and the transparent shield 128. Each of the plurality of storage slots 127 is defined by the space between any two adjacent ridges selected from the first plurality of ridges 141 and the corresponding two adjacent ridges selected from the second plurality of ridges 142.

To use the invention 100, the plurality of targets 103 are inserted into the plurality of target slots 125 such that: 1) the individual target 106 being shot at is visible through the transparent shield 128; and, 2) the tab 112 of each of the plurality of targets 103 extends beyond the structure of the target display box 104. The target display box 104 is then attached to the at least one telescoping leg 105 and is placed in a position such that the individual target 106 stored in the viewing box is facing the trainee. The trainee then shoots one of the plurality of arrows 102 at the target display box 104.

In the first potential embodiment of the disclosure, the elements of the target display box 104 other than the transparent shield 128 and the at least one telescoping leg connector 129 is made of wood. It shall be noted that the above-referenced items may be made of other materials comprising a metal, carbon composite, or a wood.

The following definitions were used in this disclosure:

Exterior Screw Thread: An exterior screw thread is a ridge wrapped around the outer surface of a tube in the form of a helical structure that is used to convert rotational movement into linear movement.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a ridge wrapped around the inner surface of a tube in the form of a helical structure that is used to convert rotational movement into linear movement Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Strip: As used in this disclosure, the term describes a long thin object of uniform width. Strips are often rectangular in shape.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A training device comprising:

a bow, a plurality of arrows, a plurality of targets, a target display box and at least one telescoping leg;

wherein the training device is adapted for indoor or outdoor use;

wherein the training device is adapted for use in teaching the use of a bow and arrow;

wherein the training device displays a target selected from the plurality of targets;

wherein each target selected from the plurality of targets further comprises images of a game animal;

wherein each target selected from the plurality of targets highlights target areas for the game animal;

wherein a target selected from the plurality of targets highlights is displayed behind a transparent shield;

wherein the bow is selected from the group consisting of longbow, recurve, or compound;

wherein each of the plurality of arrows is a full weight and size practice arrow;

wherein each of the plurality of arrows has replaceable screw in tips;

wherein each of the plurality of arrows is replaced with a replacement tip;

wherein the replacement tip further comprises a post and a suction cup;

wherein the post is formed with an exterior screw thread that is sized to fit each of the plurality of arrows;

wherein the suction cup is mounted on the post;

wherein the plurality of targets comprises a collection of individual targets;

wherein each individual target comprises an image of a potential game animal;

wherein within the image of the game animal are included indications of the appropriate target areas for the specific game animal in the image;

wherein the image is stored in a rectangular frame; wherein a tab is attached to the frame;

wherein the target display box further comprises a plurality of target slots, a transparent shield, a first plurality of ridges and a second plurality of ridges;

wherein the target display box is further defined with a front side, a bottom side, a top side, and a storage side;

wherein the target display box is further defined with a length, width, and depth;

wherein the at least one telescoping leg connector attached to the bottom side of the target display box;

wherein the transparent shield forms the front side of the target display box;

wherein the inner dimension of the length of the target display box is greater than the outer dimension of the length of each individual target;

wherein the inner dimension of the width of the target display box is greater than the outer dimension of the width of each individual target;

wherein the interior of the target display box further comprises a plurality of target slots;

wherein the plurality of target slots is formed from a first plurality of ridges and a second plurality of ridges;

wherein the first plurality of ridges run along the length of the interior surface of top side of the target display box;

wherein the second plurality of ridges run along the length of the interior surface of bottom side of the target display box;

wherein the plurality of target slots further comprises a viewing slot and a plurality of storage slots;

wherein the viewing slot is the space bounded by the following markers: the transparent shield, the first top ridge, the first bottom ridge and the transparent shield;

wherein each of the plurality of storage slots is a space defined by the span between any two adjacent ridges selected from the first plurality of ridges and the corresponding two adjacent ridges selected from the second plurality of ridges;

wherein the plurality of targets are inserted into the plurality of target slots;

whereon one of the plurality of targets is visible through the transparent shield, and is being shot at via the plurality of arrows;

wherein the tab of each of the plurality of targets extends beyond the structure of the target display box;

wherein the target display box is attached to the at least one telescoping leg;

wherein the at least one telescoping leg is used to support the target display box at an elevation above a ground surface; wherein the at least one telescoping leg is adjustable, which enables the elevation of the target display box to adjust;

wherein two of the at least one telescoping leg is hingedly attached to the bottom side of the target display box;

wherein one of the at least one telescoping leg is hingedly attached to a rear surface of the target display box;

wherein the rear surface is distal of the transparent shield.

2. The training device according to claim 1 wherein a leg connector is used to secure the at least one telescoping leg to the target display box; wherein the leg connector enables the respective one of the at least one telescoping leg to pivot with respect to the target display box in order to support the target display box at the elevation.

3. The training device according to claim 2 wherein the at least one telescoping leg is further defined with a plurality of telescoping sections that telescope with respect to one another in order to extend or retract; wherein a spike member is provided at a distal end of a bottommost telescoping section; wherein the spike member is distal of the leg connector; wherein the spike member is adapted to penetrate the ground surface in order to stabilize the training device.

* * * * *